US006073697A

United States Patent [19]

Parlin et al.

[11] Patent Number: 6,073,697

[45] Date of Patent: Jun. 13, 2000

[54] LATERAL WELLBORE JUNCTION HAVING DISPLACEABLE CASING BLOCKING MEMBER

[75] Inventors: Joseph D. Parlin, Plano; John C. Gano, Carrollton; Tommie A. Freeman, Flower Mound; James R. Longbottom, Magnolia; Dana R. Dale, Houston, all of Tex.

[73] Assignee: Halliburton Energy Services, Inc., Houston, Tex.

[21] Appl. No.: 09/047,042

[22] Filed: Mar. 24, 1998

[51] Int. Cl.[7] ..... E21B 43/14

[52] U.S. Cl. ..... 166/313; 166/50; 166/117.6

[58] Field of Search ..... 166/313, 50, 380, 166/117.6, 334.1

[56] References Cited

U.S. PATENT DOCUMENTS

| | | | |
|---|---|---|---|
| 5,462,120 | 10/1995 | Gondouin . | |
| 5,520,252 | 5/1996 | McNair | 166/313 |
| 5,566,763 | 10/1996 | Williamson et al. | 166/313 |
| 5,735,350 | 4/1998 | Longbottom et al. | 166/313 |
| 5,787,987 | 8/1998 | Forsyth et al. | 166/313 |
| 5,803,178 | 9/1998 | Cain | 166/50 |
| 5,927,401 | 7/1999 | Morris et al. | 166/334.1 |

FOREIGN PATENT DOCUMENTS

| | | |
|---|---|---|
| 2297779 | 8/1996 | United Kingdom . |
| 2304764 | 3/1997 | United Kingdom . |

*Primary Examiner*—William Neuder
*Attorney, Agent, or Firm*—Konneker and Smith

[57] ABSTRACT

A lateral wellbore junction is formed by methods and apparatus described herein. In one described embodiment, an apparatus includes a section of casing and a sleeve axially reciprocably disposed relative to an opening formed through a sidewall of the casing. In one described method, the casing section is positioned within a parent wellbore, the sleeve is shifted to provide access through the opening, and a lateral wellbore is drilled by passing cutting tools through the opening.

62 Claims, 8 Drawing Sheets

LATERAL WELLBORE JUNCTION HAVING DISPLACEABLE CASING BLOCKING MEMBER

BACKGROUND OF THE INVENTION

The present invention relates generally to operations performed in conjunction with subterranean wells and, in an embodiment described herein, more particularly provides apparatus and methods for forming wellbore junctions.

Wellbore junctions are formed when a second wellbore is drilled intersecting a first wellbore. In a typical drilling program, the first wellbore may be designated a "parent" or "main" wellbore, and the second wellbore may be designated a "lateral" or "branch" wellbore. Depending upon the type of well, the type of formation surrounding the wellbore junction, etc., it is usually important for the completed wellbore junction to provide access to the parent wellbore above and below the junction, and to provide access to the lateral wellbore, and for the wellbore junction to prevent migration of fluids between formations intersected by the wellbores. It is also important for the casing, liners, or other conduits installed at or through the junction to be isolated from fluid communication with the formation surrounding the junction.

Of course, it is additionally important for the wellbore junction formation operation to be convenient and efficient, in order to save valuable rig time, and for the resulting junction to be reliable and long-lasting. Unfortunately, most prior methods of forming wellbore junctions have required time-consuming milling operations, in which openings are formed laterally through casing positioned in the parent wellbores at the junctions. The openings are formed so that cutting tools, such as drill bits, reamers, etc., may be passed through the openings in order to drill lateral wellbores extending outwardly from the parent wellbores. It would, therefore, be highly advantageous to provide apparatus and methods of forming a wellbore junction which do not require cutting through a casing sidewall downhole prior to drilling a lateral wellbore.

It is accordingly an object of the present invention to provide such apparatus and methods. Other objects and advantages of the present invention are set forth below.

SUMMARY OF THE INVENTION

In carrying out the principles of the present invention, in accordance with an embodiment thereof, a wellbore junction apparatus is provided which includes a tubular member having an opening formed through a sidewall thereof. The opening is selectively blocked by a blocking member. In a method provided by the present invention, the blocking member is shifted downhole to provide access through the opening, thereby permitting cutting tools to be passed through the opening for drilling a lateral wellbore.

In one aspect of the present invention, the blocking member is a sleeve externally disposed about a section of casing. The sleeve may be shifted relative to the casing by engaging one or more shifting profiles formed internally on the sleeve and accessible via the opening, by applying fluid pressure to a hydraulic actuator attached thereto, etc.

In another aspect of the present invention, a conduit may be installed through the opening and inserted into the lateral wellbore. A flange may be attached to the conduit. The flange may be sealingly engaged with the tubular member about a periphery of the opening, thereby providing fluid isolation between the tubular member and conduit, and the formation surrounding the wellbore junction.

In another aspect of the present invention, the flange may be biased into engagement with the tubular member. A biasing force may be applied by an anchoring device attached to the conduit, may be applied by the sleeve, etc. Furthermore, the sleeve may have a profile formed thereon which engages a complementarily shaped profile on a portion of the flange extending through the opening. Such engagement may provide the biasing force and/or may secure the flange relative to the tubular member.

In still another aspect of the present invention, the sleeve may be shielded from contact with a sidewall of the parent wellbore, and/or from contact with cement placed in the parent wellbore, by an enclosure outwardly surrounding the sleeve. The enclosure may be an inflatable membrane attached externally to the tubular member. If inflatable, the membrane may be radially outwardly extended in response to fluid pressure within the tubular member. Additionally, decentralizing devices may be attached to the tubular member, in order to provide increased clearance between the opening and the parent wellbore sidewall. The decentralizing devices may also be responsive to fluid pressure within the tubular member.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1A:
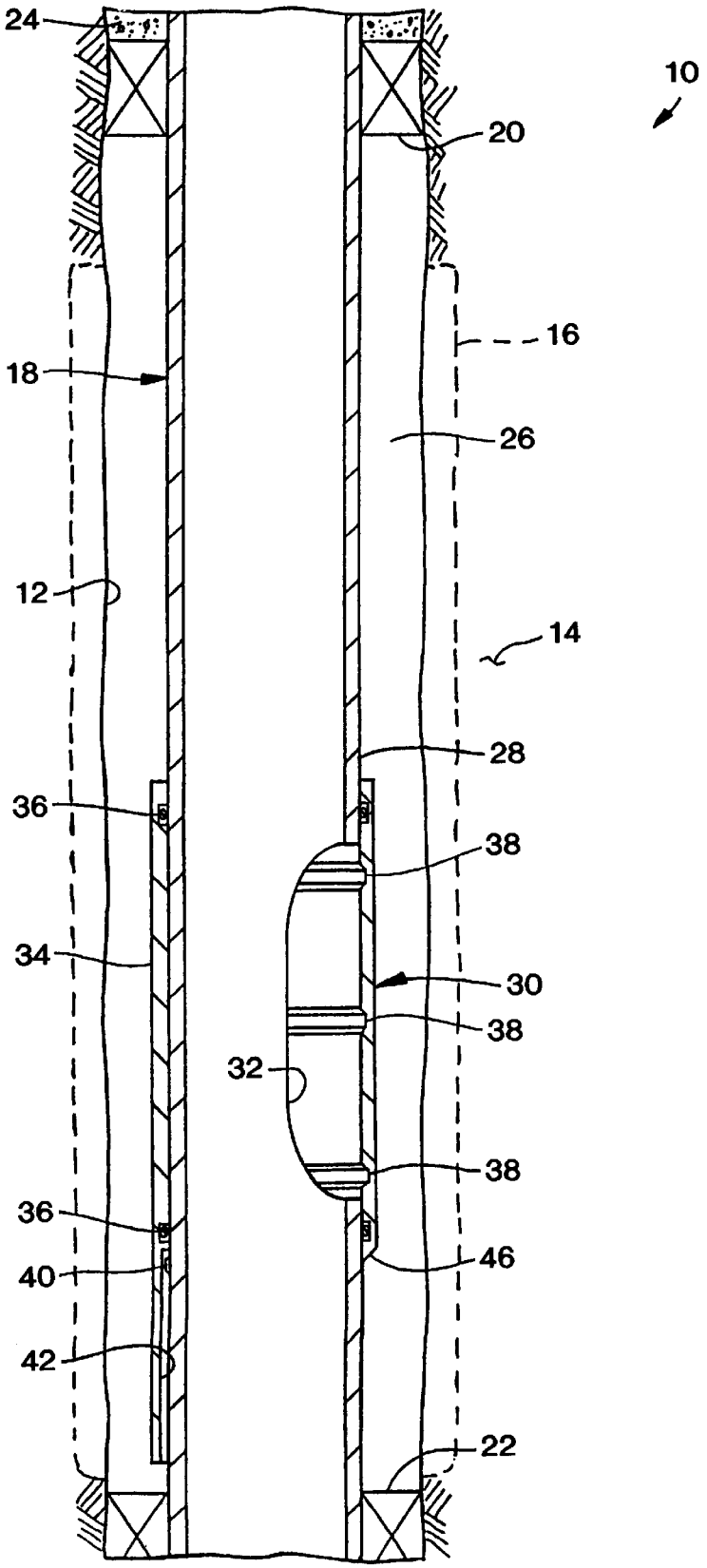
FIGS. 1A–1D are schematic cross-sectional views of a first method and apparatus for forming a lateral wellbore junction, the apparatus and method each embodying principles of the present invention.

Representatively and schematically illustrated in FIGS. 1A–1D is a method 10 of forming a wellbore junction which embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

As depicted in FIGS. 1A–1D, initial steps of the method 10 have been performed. A first or parent wellbore 12 has been drilled intersecting an earth strata or formation 14. The parent wellbore 12 may optionally be underreamed or otherwise radially enlarged, as indicated by the dashed lines 16, but it is to be clearly understood that such underreaming is not necessary in the method 10.

A casing string 18 is then installed in the parent wellbore 12. Although shown schematically as a single tubular member in FIGS. 1A–1D, the casing string 18 may actually be segmented, may include multiple casing sections, may include other tools and/or equipment, may include conventional devices, such as a cementing shoe, float collar, etc. For example, the casing string 18 as viewed in FIG. 1A includes spaced apart packers 20, 22 interconnected therein.

The packers 20, 22 may be inflatable packers of the type well known to those skilled in the art, or may be other types of packers. In the method 10 as shown in FIGS. 1A–1D, the packers 20, 22 are set in the wellbore 12 prior to a cementing operation, for purposes that will be described more fully below. Cement 24 or another cementitious material is flowed into an annulus 26 formed radially between the casing string 18 and the wellbore 12. Using techniques well known to those skilled in the art, the cement 24 is forced into the annulus 26 above the upper packer 20 and below the lower packer 22, but not between the packers.

A section 28 of the casing string 18 is disposed axially between the packers 20,22. This section 28 is a part of an overall apparatus 30 embodying principles of the present invention. The casing section 28 may be integrally formed with other portions of the casing string 18, or may be separately attached thereto.

An opening 32 is formed through a sidewall of the casing 28. As shown in FIGS. 1A–1D, the opening is oval-shaped and axially extended relative to the casing 28. However, it is to be clearly understood that the opening 32 may be otherwise-shaped and oriented without departing from the principles of the present invention. For example, the opening 32 could be rectangular or elliptical and could be circumferentially elongated. When installed in the wellbore 12, the opening 32 may be radially oriented relative to the wellbore by using a conventional gyroscope, highside indicator, or other means, so that the opening faces toward a desired point of intersection with a lateral wellbore 60 (see FIG. 1B).

The apparatus 30 also includes a blocking member or sleeve 34. The sleeve 34 as shown in FIGS. 1A–1D is generally tubular, is externally disposed relative to the casing 28, and is axially reciprocable relative to the casing to block or permit access through the opening 32. Of course, it will be readily appreciated that it is not necessary for the blocking member 34 to be tubular, it could be internally disposed in the casing 28, and could be rotationally or otherwise displaceable relative to the casing.

As shown in FIG. 1A, the sleeve 34 is blocking access through the opening 32. Circumferential seals 36 are carried internally on the sleeve 34, so that, in this position, the sleeve sealingly engages the casing 28 above and below the opening 32. Thus, fluid flow is prevented through the opening 32. This configuration of the apparatus 30 is advantageous during the cementing operation described above, in order to prevent cement from flowing outward through the opening 32.

The sleeve 34 includes axially spaced apart shifting profiles 38 formed internally thereon. The profiles 38 are accessible via the opening 32 and may be engaged by a shifting tool (not shown) of the type well known to those skilled in the art. As described more fully below, the profiles 38 may be engaged by the shifting tool and a force applied thereto to shift the sleeve 34 relative to the opening 32. Any number of the profiles 38 may be provided, and it is to be clearly understood that the sleeve 34 may be otherwise displaced relative to the casing 28, such as by application of fluid pressure to a hydraulic actuator attached thereto (see FIG. 1D), without departing from the principles of the present invention.

The apparatus 30 may further include an optional projection or key 40 formed externally on the casing 28. The key 40 is received in a axially extending optional recess or keyway 42 formed internally on the sleeve 34. Engagement between the key 40 and keyway 42 maintains alignment between the sleeve 34 and casing 28. Other means of maintaining alignment may be utilized, such as splines, etc., and the means may be otherwise oriented, for example, if the blocking member 34 displaces circumferentially or rotates relative to the opening 32, the alignment means may be circumferentially oriented, etc.

Figure 1B:
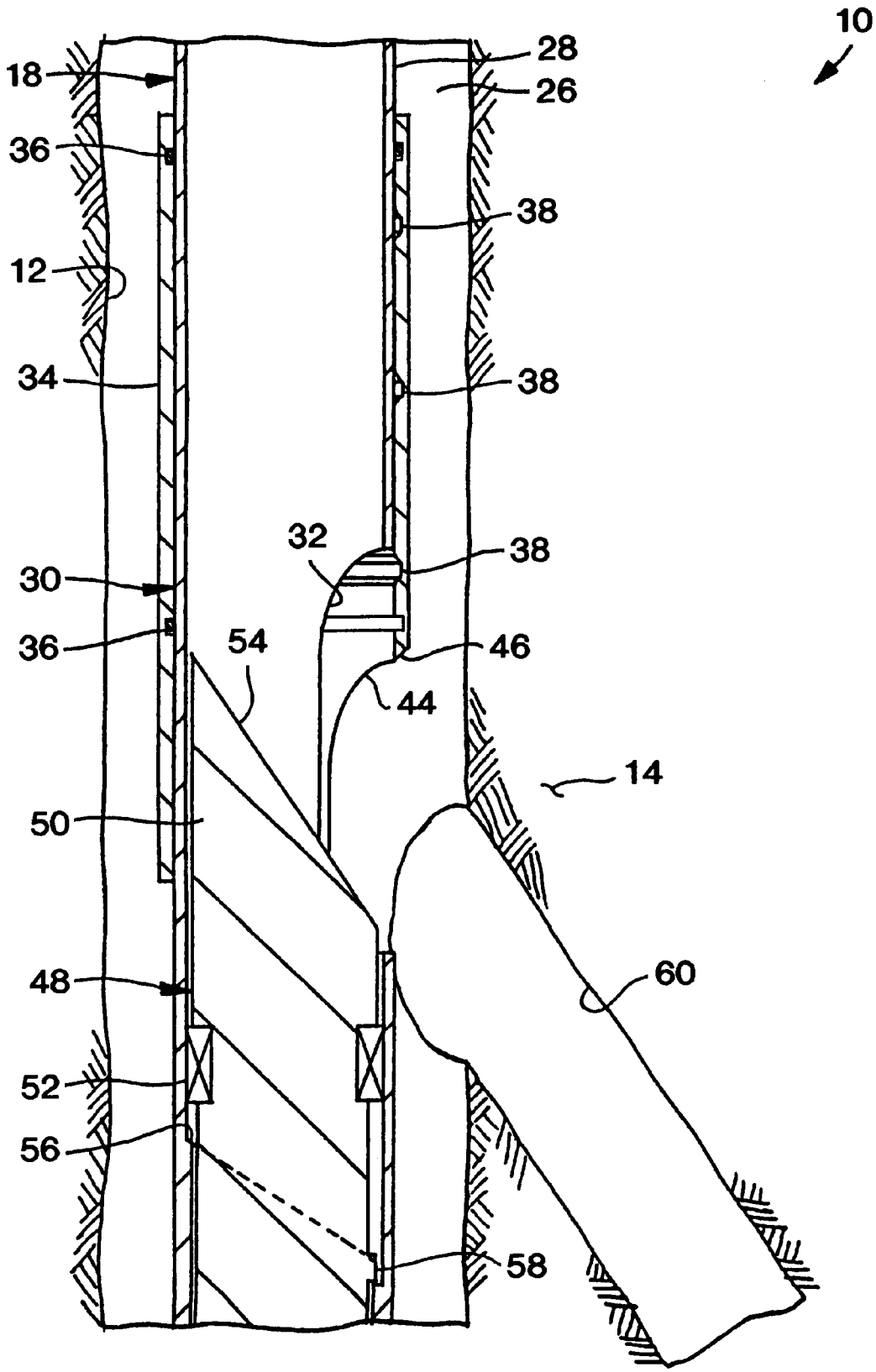

In FIG. 1B it may be seen that the sleeve 34 has been shifted upward relative to the opening 32, so that access is now permitted through the opening. It will now be appreciated that the cement 24 is not placed between the packers 20, 22 as described above, so that the sleeve 34 is free to displace externally on the casing 28. In this view it may also be seen that the sleeve 34 has a profile 44 formed thereon, the profile including an inclined edge 46.

The apparatus 30 now also includes a deflection device assembly 48, which has been installed in the casing 28, for example, by conveying it downwardly through the casing string 18 from the earth's surface. The deflection device assembly 48 includes a deflection device or whipstock 50, and an optional anchoring device or packer 52. When installed in the casing 28, an upper laterally inclined deflection surface 54 is radially oriented to face toward the opening 32. Such radial orientation may be accomplished by using a gyroscope, highside indicator, etc., according to conventional techniques.

Alternatively, the deflection device assembly 48 may be engaged with a helical orienting profile 56 of the apparatus 30. For example, a projection 58 of the assembly 48 may engage the profile 56 as the assembly is lowered into the casing 28, thereby automatically orienting the surface 54 to face toward the opening 32. If provided, the packer 52 may then be set in the casing 28 to anchor the assembly 48 therein and to aid in preventing debris from being trapped between the assembly 48 and the casing 28. Note that the orienting profile 56 may be used to orient the shifting tool (not shown), so that the shifting tool may properly engage the profiles 38 through the opening 32 for displacing the sleeve 34 as described above. As representatively depicted herein, the profile 56 is formed at a reduction of the inner diameter of the casing 28, but other alignment profiles are commercially available which do not require a reduced inner diameter, and any of these may be used in place of the profile 56.

In the configuration shown in FIG. 1B, one or more cutting tools, such as drill bits, reamers, etc. (not shown), may be lowered through the casing string 18 and deflected laterally by the surface 54 through the opening 32. In this manner, a second or lateral wellbore 60 may be drilled intersecting the parent wellbore 12. Of course, it is well known to deflect cutting tools off of a whipstock to drill a lateral wellbore, but the method 10 permits drilling the lateral wellbore 60 through the casing string 18, without the need to mill through the casing 28, and without the need to form the casing out of a relatively weak, brittle, and/or expensive drillable material, such as fiber-reinforced resin, plastic, or aluminum, etc.

Figure 1C:
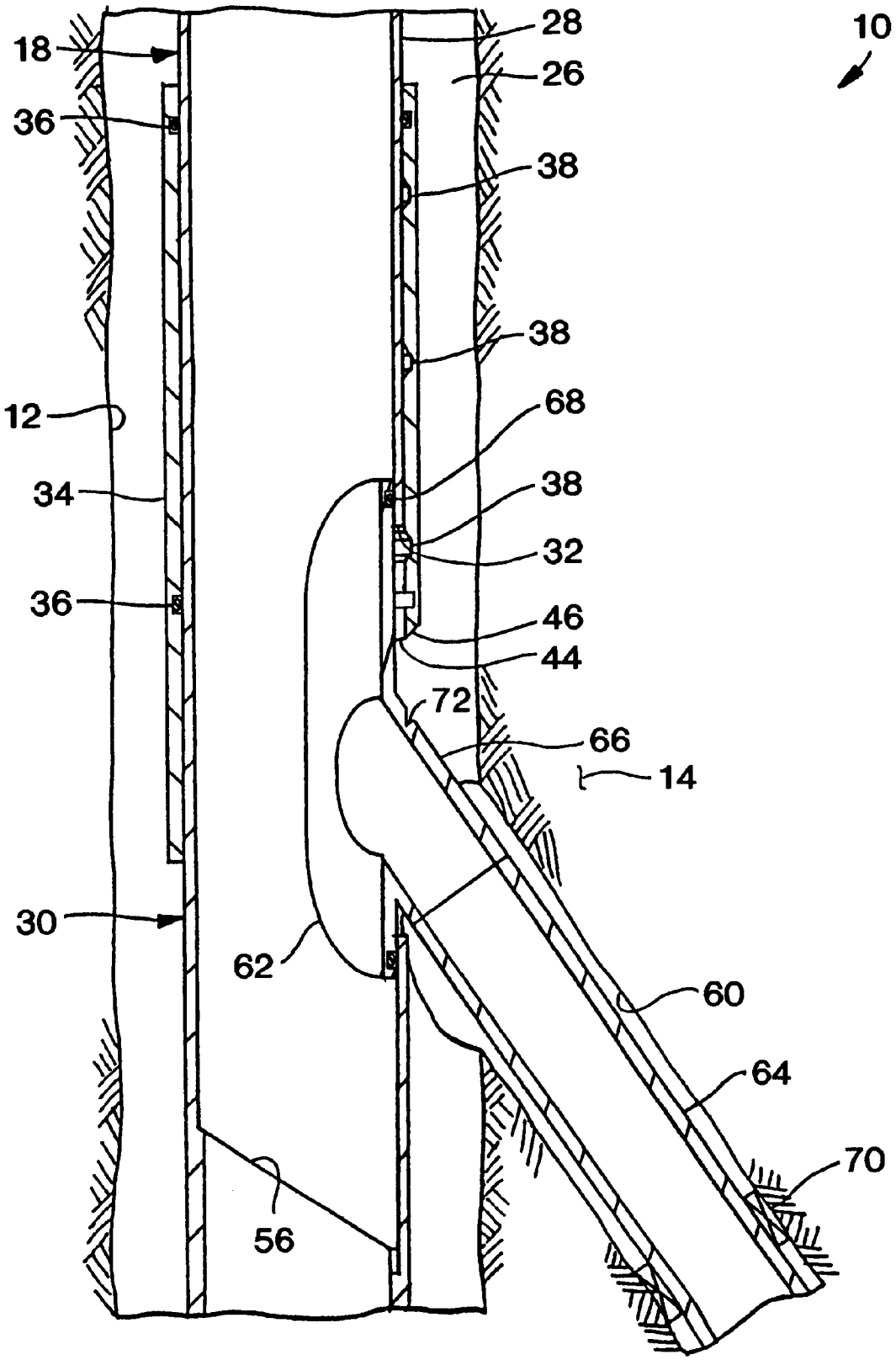

In FIG. 1C it may be seen that the deflection device assembly 48 has been retrieved from within the apparatus 30. A flange 62 and attached conduit or liner 64 have been installed in the apparatus 30, so that the liner extends outwardly from the opening 32. The flange 62 and conduit 64 are shown as separate elements in FIG. 1C, however, it is to be clearly understood that they may be integrally formed, or may be made up of multiple elements, without departing from the principles of the present invention.

The flange 62 and conduit 64 may also be conveyed into the casing string 18 attached as shown in FIG. 1C, or may be separately conveyed. For example, the flange 62 may be installed in the casing 28 initially and the conduit 64 later attached to the flange. This could be accomplished by providing a conventional polished bore receptacle (not shown) on the flange 62 and sealingly engaging the conduit 64 with the receptacle.

The flange 62 is shown in FIG. 1C as being made of metal, but it is to be clearly understood that the flange may be made of other materials. For example, to aid in passing the flange 62 through the casing string 18, the flange could be made of an elastomeric material so that it could be "folded" or otherwise deformed if need be, until it is appropriately positioned within the apparatus 30. Such "folding" or other deforming of the flange 62 could also be accomplished if the flange were made of a deformable steel or other material.

A portion 66 extends outwardly through the opening 32. The portion may be a portion of the flange 62 as shown in FIG. 1C, a portion of the conduit 64, or a separately formed portion of the apparatus 30. The profile 44 of the sleeve 34 is complementarily shaped relative to the exterior of the portion 66, for purposes that will be more fully described below.

The flange 62 is positioned so that it contacts the interior of the casing 28 sidewall about a periphery of the opening 32. Sealing engagement may be provided by a seal 68 carried on the flange 62. Alternatively, the flange 62 may be adhesively bonded to the periphery of the opening 32, otherwise engaged with the opening, etc. The sealing engagement between the flange 62 and the casing 28 as shown in FIG. 1C provides fluid isolation between the interior of the casing and the annulus 26, and between the liner 64 and the annulus. It will be readily appreciated that the flange 62 could additionally or alternatively sealingly engage the interior of the sleeve 34, for example, by appropriately positioning the seal 68 between the flange and the sleeve, adding another sealing device for this purpose, etc.

The flange 62 may be biased into contact with the casing 28. For example, an anchoring device or packer 70 attached to the liner 64 may be utilized to exert a downwardly biasing force on the liner, thereby biasing the flange 62 against the interior surface of the casing 28 and maintaining sealing engagement therebetween. Other methods of biasing the flange 62 are described below.

Figure 1D:
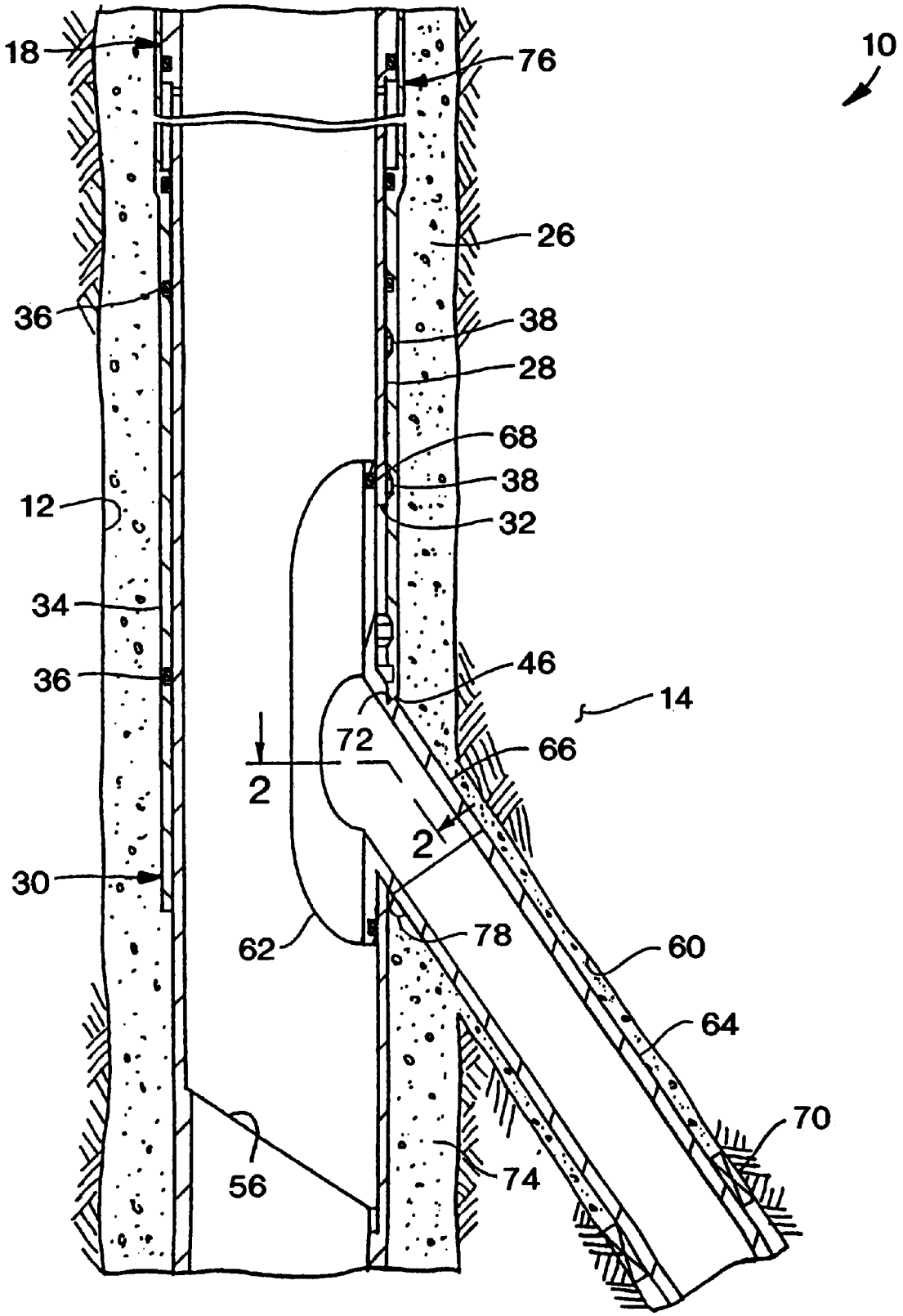

In FIG. 1D, it may be seen that the sleeve 34 has been downwardly shifted relative to the casing 28, as compared to that shown in FIG. 1C The inclined edge 46 of the profile 44 on the sleeve 34 is now engaged with the portion 66. Such engagement secures the flange 62 relative to the casing 28, preventing relative movement therebetween, and may also bias the flange 62 into contact with the casing 28. This biasing is due to engagement between the inclined edge 46 and a complementarily shaped recess 72 formed on the portion 66. Of course, the edge 46 and recess 72 may be otherwise shaped without departing from the principles of the present invention.

FIG. 1D also shows an alternate configuration of the opening 32, in which a lower portion of the opening engages the flange 62, thereby supporting the flange and further restricting lateral movement of the flange relative to the casing 28. Although the lower portion of the opening 32 is shown in FIG. 1D as being generally tapered or wedge-shaped and complementarily engaging the portion 66, it is to be understood that other shapes and types of engagements may be utilized, without departing from the principles of the present invention.

In addition, note that FIG. 1D shows an optional projection 78 formed externally on the liner 64 opposite the casing 28 from the flange 62. The projection 78 operates to enhance the structural integrity of the flange-to-casing engagement by further restricting lateral displacement of the flange 62 relative to the casing 28, and by supporting the periphery of the opening 32. Additional projections 78 may be provided or may be continuously formed about the area where the portion 66 extends through the lower portion of the opening 32. The projection 78 is shown as having a generally semi-circular cross-section, but other shapes could be utilized, and the projection could be complementarily shaped relative to the exterior of the casing 28, in keeping with the principles of the present invention.

Figure 2:
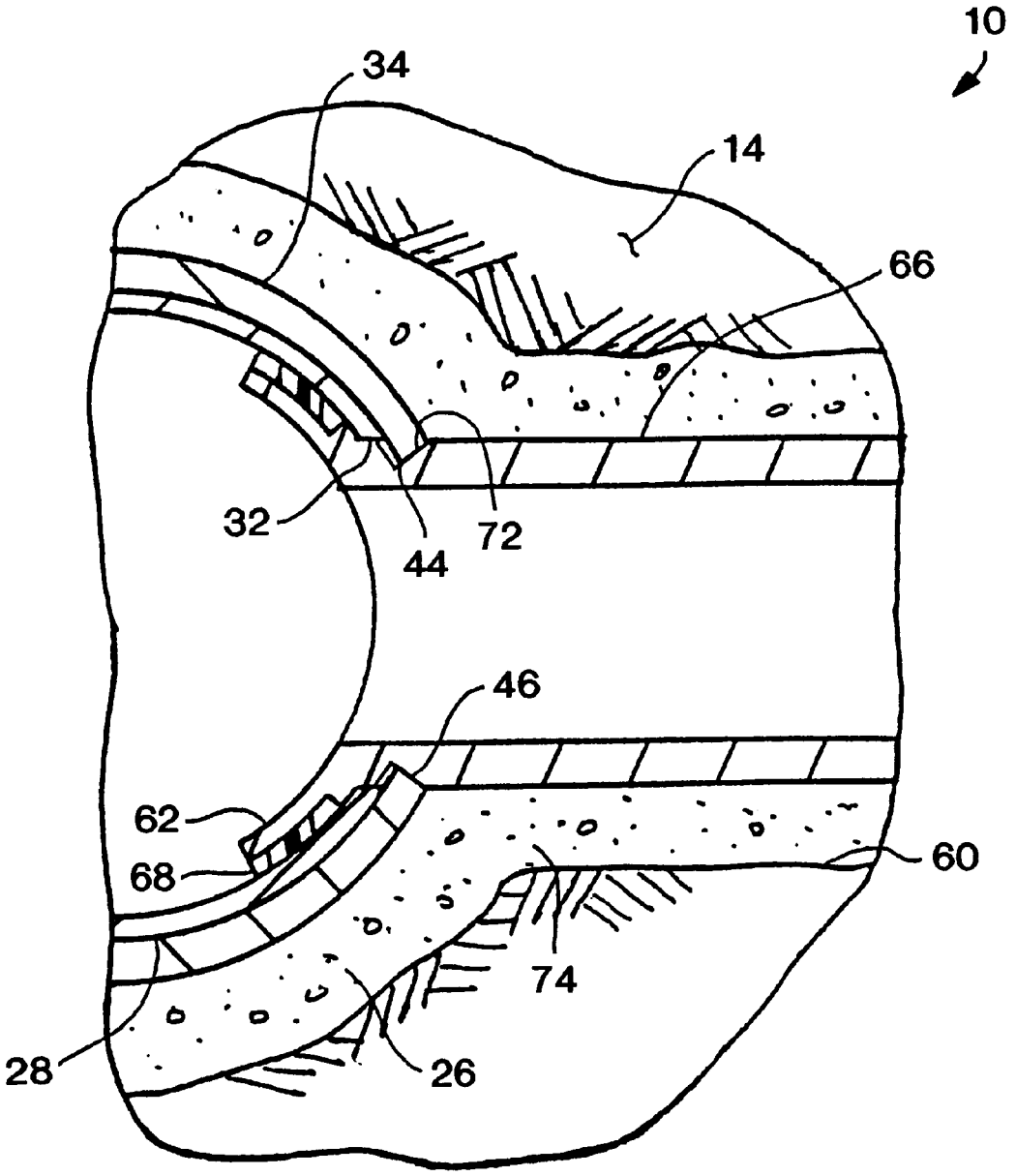
FIG. 2 is an enlarged scale cross-sectional view through the wellbore junction, taken along line 2—2 of FIG. 1D, FIGS. 3A & 3B are schematic cross-sectional views of a second method and apparatus for forming a lateral wellbore junction, the apparatus and method each embodying principles of the present invention.

Referring additionally now to FIG. 2, an enlarged cross-sectional view is shown of the interconnection between the sleeve 34, flange 62, portion 66, and casing 28. In this view it may be clearly seen that the profile 44 engages the recess 72 to either side of the portion 66, and that this engagement applies an outwardly biasing force to the flange 62. This biasing force may be utilized to compress the seal 68 (shown in FIG. 2 in an optional form) between the flange 62 and the inner side surface of the casing 28.

Note that this engagement also prevents relative motion between the flange 62, portion 66 and liner 64. Thus, cement 74 forced into the space between the apparatus 30 and the wellbores 12, 60 is not easily cracked due to such relative motion and the overall stability of the wellbore junction is significantly enhanced.

Referring again to FIG. 1D, note that an optional hydraulic actuator 76 is shown attached to the apparatus 30. As representatively illustrated, the hydraulic actuator 76 is formed by differential piston areas on the casing 28 and sleeve 34, so that fluid pressure applied within the casing will cause the sleeve to be biased downwardly. Of course, fluid pressure could be otherwise applied, such as via a control line extending to another part of the well, additional differential piston areas could be provided to bias the sleeve upwardly, and other types of hydraulic actuators could be provided, without departing from the principles of the present invention.

Figure 3A:
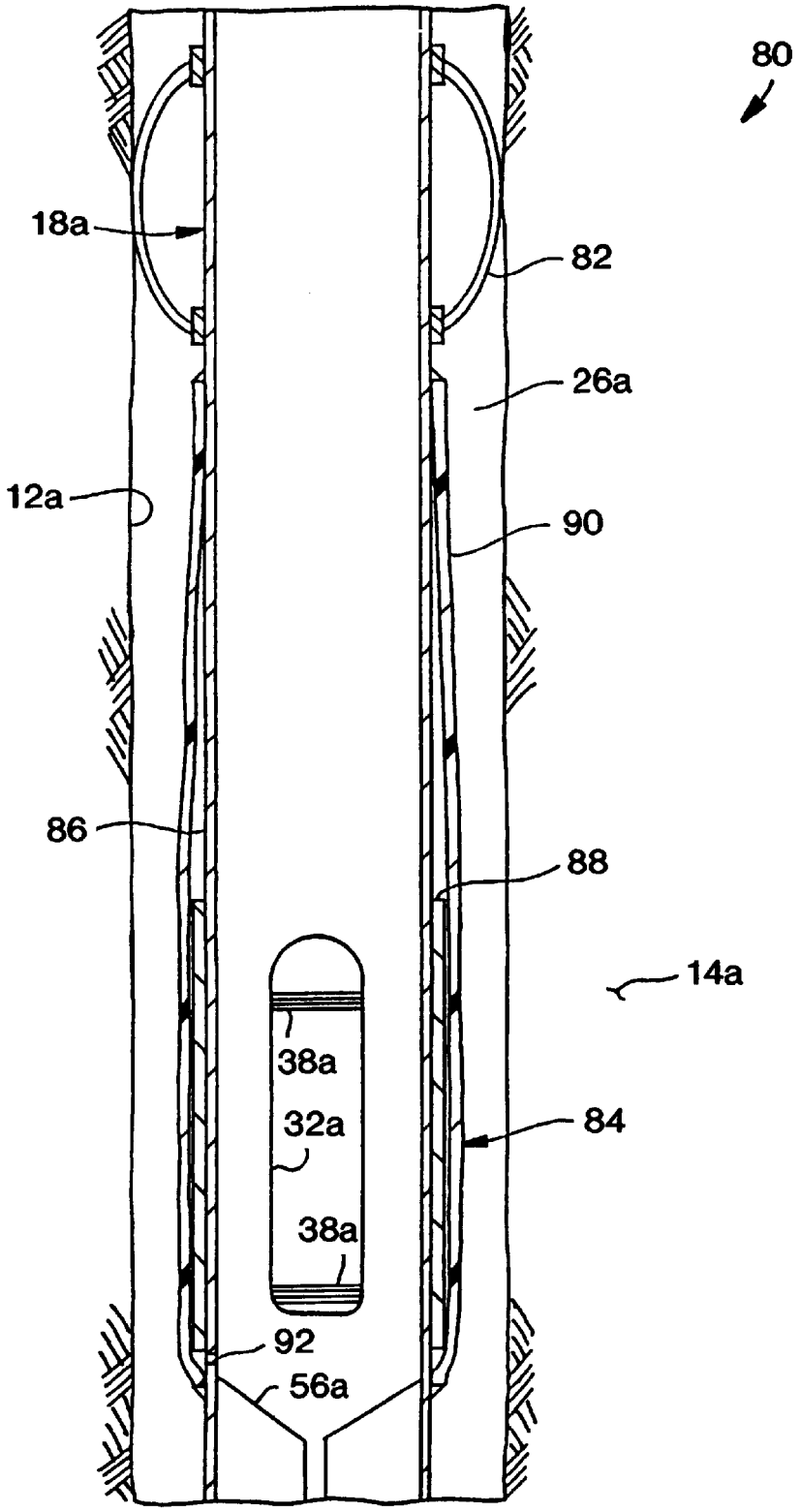
Figure 3B:
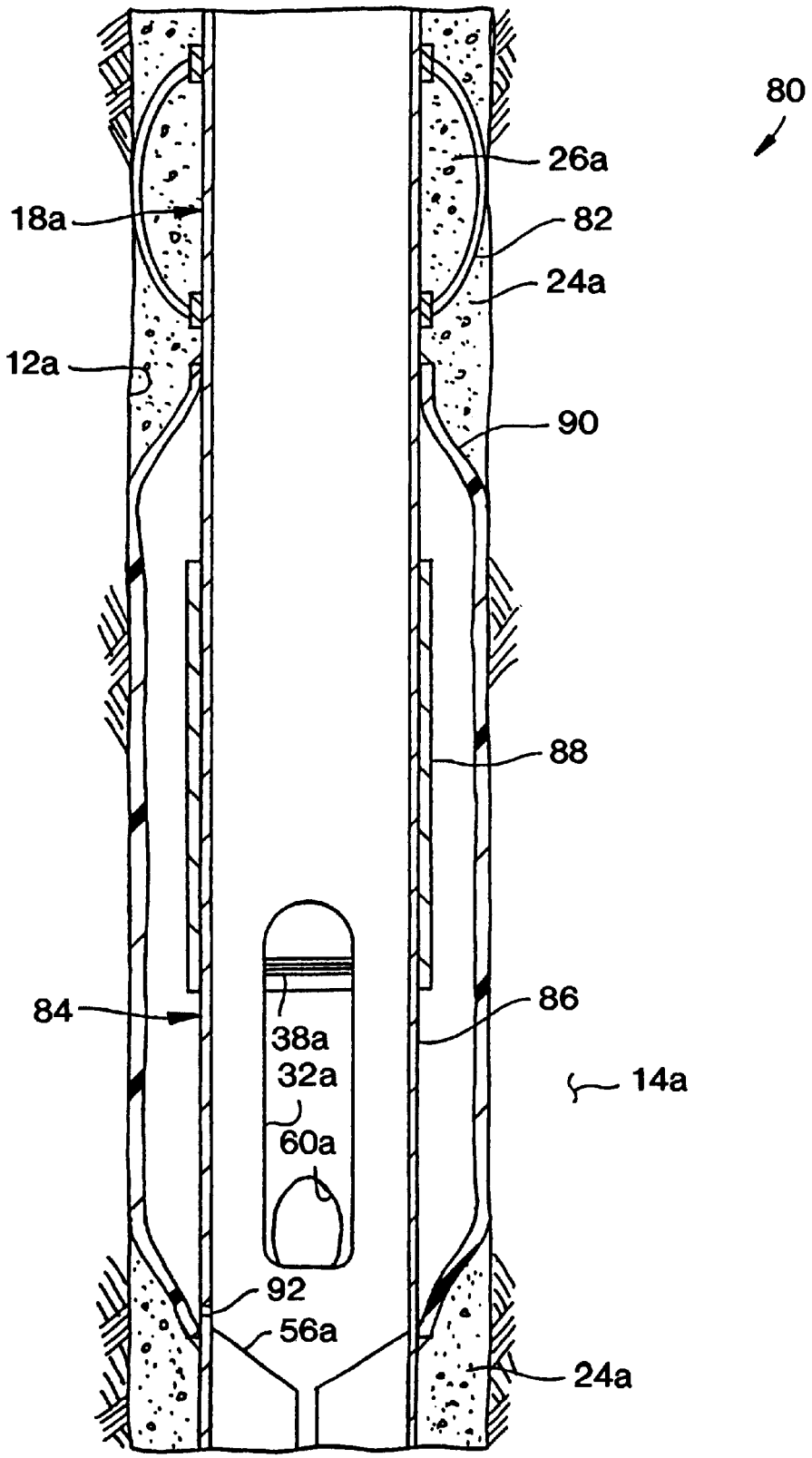

Referring additionally now to FIGS. 3A & 3B, another method 80 of forming a wellbore junction is schematically and representatively illustrated. Elements which are similar to those previously described are indicated in FIGS. 3A & 3B using the same reference numbers, with an added suffix "a".

In the method 80, the casing string 18*a* includes one or more centralizers 82 and an apparatus 84 for forming the wellbore junction. The apparatus 84 includes a section of casing 86, a sleeve 88 and a shielding device or enclosure 90 outwardly surrounding the sleeve. As with the apparatus 30 described above, the sleeve 88 may be shaped differently from that shown, may be displaceable relative to the casing 86 in any of a variety of manners, may be internally or externally disposed relative to the casing, may be sealingly engaged with the casing, may have an actuator attached thereto, may include other profiles formed thereon, etc. In the configuration shown in FIG. 3A, the sleeve 88 is in a position in which it blocks access through the opening 32*a*.

The enclosure 90 may be a membrane, may be made of an elastomeric material, may be similar in many respects to an inflatable packer element, and is radially outwardly extendable relative to the casing 86. In the method 80, the enclosure 90 prevents the sleeve 88 from contacting cement 24*a* flowed into the annulus 26*a*, and provides radial clearance about the apparatus 84. For this purpose, the enclosure 90 is externally and sealingly attached at its opposite ends to the casing 86 above and below the sleeve 88. A port 92 provides fluid communication between the interior of the enclosure 90 and the interior of the casing 86. However, it is to be clearly understood that the enclosure 90 could be otherwise attached, made of different materials, such as metal, mechanically or otherwise extendable instead of inflatable, etc., without departing from the principles of the present invention.

In FIG. 3B, the apparatus 84 is shown with the enclosure 90 outwardly extended into sealing engagement with the wellbore 12*a* To extend the enclosure 90, fluid pressure has been applied to the interior of the casing 86, thereby inflating the enclosure via the port 92. Note, however, that it is not necessary in the method 80 for the enclosure 90 to sealingly engage the wellbore 12*a*, for example, the enclosure could extend only partially radially between the casing 86 and the wellbore.

Cement 24*a* is flowed into the annulus 26*a* above and below the apparatus 84. The cement 24*a* may be flowed into the annulus before the enclosure 90 is outwardly extended, so that the cement does not need to be flowed separately above and below the enclosure or otherwise "staged". If the enclosure 90 is outwardly extended, but does not sealingly engage the wellbore 12*a*, the cement 24*a* may also flow radially between the enclosure 90 and the wellbore. The cement 24*a* is permitted to harden and the sleeve 88 is shifted upwardly relative to the casing 86 to permit access through the opening 32*a*. A lateral wellbore 60*a* is then drilled by deflecting one or more cutting tools laterally through the opening 32*a* For this purpose, and in a manner similar to that described above for the method 10, a deflection device assembly may be installed in the apparatus 84 and oriented with respect thereto using an orienting profile 56*a*.

When the lateral wellbore 60*a* is drilled, the cutting tool will cut through the enclosure 90, since it is positioned between the opening 32*a* and the wellbore 12*a*. After the lateral wellbore 60*a* has been drilled, a flange and liner may be installed as described above for the method 10. The sleeve 88 may include a profile, such as the profile 44, for engaging, biasing and/or securing the flange or another portion as described above. In these respects, the method 80 may be substantially similar to the method 10, and will not be further described herein. However, it is to be clearly understood that the method 80 may also differ in many respects from the method 10, without departing from the principles of the present invention.

Figure 4:
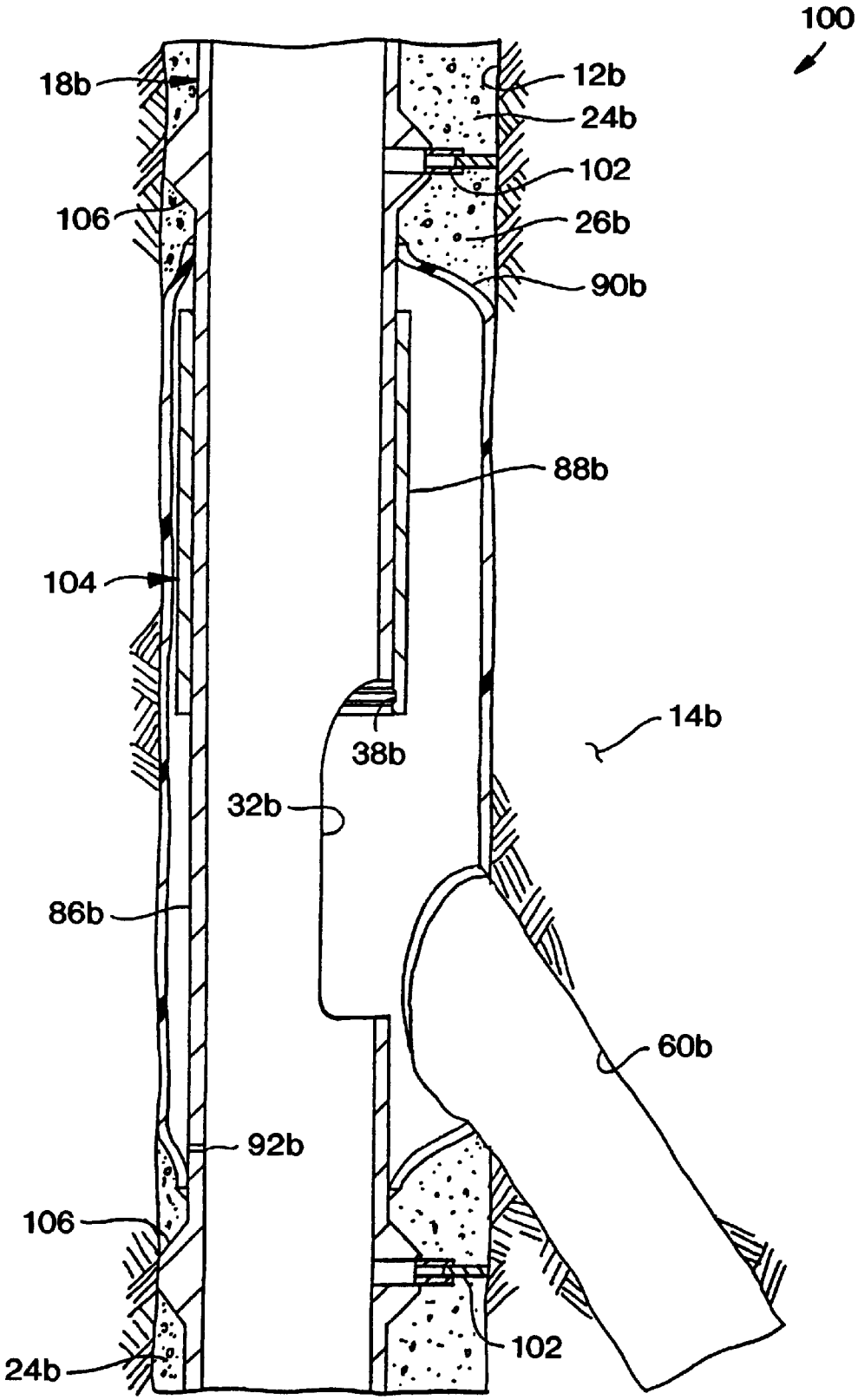
FIG. 4 is a schematic cross-sectional view of a third method and apparatus for forming a lateral wellbore junction, the apparatus and method each embodying principles of the present invention.

Referring additionally now to FIG. 4 another method 100 of forming a wellbore junction is representatively and schematically illustrated. Elements which are similar to those previously described are indicated in FIG. 4 using the same reference numbers, with an added suffix "b".

The method 100 is in many respects similar to the method 80. However, in the method 100, the casing string 18*b* is decentralized in the wellbore 12*b* prior to flowing the cement 24*b* into the annulus 26*b*. For this purpose, decentralizers 102 are provided in an overall apparatus 104 above and below the enclosure 90*b*. Standoffs 106 are provided opposite the decentralizers 102, so that there is clearance about the sleeve 88*b* when the decentralizers are extended to decentralize the apparatus 104 within the wellbore 12*b*.

As depicted in FIG. 4, the decentralizers 102 are made up of telescoping pistons which are radially outwardly extended by applying fluid pressure to the interior of the casing 86*b*. It is to be clearly understood, however, that the decentralizers 102 could be otherwise configured, for example, as hydraulically or mechanically actuated wedges, etc.

Note that fluid pressure may be applied to the interior of the casing 86*b* to extend the decentralizers 102, radially outwardly extend the enclosure 90*b*, and shift the sleeve 88*b* (if a hydraulic actuator is attached thereto). These may occur simultaneously or sequentially, for example, by utilizing shear members, such as shear pins, to delay actuation of one or more of these elements.

With the decentralizers 102 and enclosure 90*b* extended, the cement 24*b* is flowed into the annulus 26*b* and permitted to harden. With the sleeve 88*b* shifted upward to permit access through the opening 32*b*, one or more cutting tools are deflected outwardly through the opening to cut through the enclosure 90*b* and drill the lateral wellbore 60*b*. A deflection device assembly may be used as described above for laterally deflecting the cutting tools. Decentralization of the apparatus 104 permits increased clearance between the apparatus and the wellbore 12*b* during this and subsequent operations.

After the lateral wellbore 60*b* has been drilled, a flange and liner may be installed as described above for the method 10. The sleeve 88*b* may include a profile, such as the profile 44, for engaging, biasing and/or securing the flange or another portion as described above. In these respects, the method 100 may be substantially similar to the method 10, and will not be further described herein. However, it is to be clearly understood that the method 100 may also differ in many respects from the method 10, without departing from the principles of the present invention.

The foregoing detailed description is to be clearly understood as being given by way of illustration and example only, the spirit and scope of the present invention being limited solely by the appended claims.

What is claimed is:

1. A method of forming a wellbore junction, the method comprising the steps of:

drilling a first wellbore;

providing a tubular member interconnected in a tubular string, the tubular member having an opening formed through a sidewall portion thereof, and a blocking member selectively positionable relative to the opening in a first position in which the blocking member blocks the opening and a second position in which the blocking member permits access through the opening;

positioning the tubular member within the first wellbore;

cementing the tubular string within the first wellbore;

shielding the blocking member during the cementing step in a manner permiting the blocking member to be shifted from its first position to its second position subsequent to the perfomance of the cementing step;

positioning the blocking member in the second position; and drilling a second wellbore by passing at least one cutting tool through the opening.

2. The method according to claim 1, further comprising the step of sealingly engaging the blocking member with the tubular member when the blocking member is in the first position, the blocking member thereby preventing fluid flow through the opening.

3. The method according to claim 1, wherein the second wellbore drilling step further comprises installing a deflection device assembly including a deflection device within the tubular member, and deflecting the at least one cutting tool off of the deflection device.

4. The method according to claim 3, wherein the installing step further comprises aligning a laterally inclined face of the deflection device with the opening.

5. The method according to claim 3, wherein the installing step further comprises engaging the deflection device assembly with an orienting profile.

6. The method according to claim 1, further comprising the step of shifting the blocking member between its first and second positions after the tubular member positioning step.

7. The method according to claim 6, wherein the shifting step is performed by engaging a shifting profile formed on the blocking member.

8. The method according to claim 6, wherein the shifting step is performed by applying fluid pressure to the tubular member.

9. The method according to claim 1, further comprising the step of engaging a flange with the tubular member about a periphery of the opening.

10. The method according to claim 9, wherein the flange engaging step further comprises sealingly engaging the flange with the tubular member.

11. The method according to claim 9, further comprising the steps of attaching a conduit to the flange, and installing the conduit within the second wellbore.

12. The method according to claim 11, wherein the conduit installing step further comprises passing the conduit through the opening.

13. The method according to claim 12, wherein the conduit installing step further comprises biasing the conduit outwardly relative to the opening, thereby biasing the flange against an interior surface of the tubular member.

14. The method according to claim 11, further comprising the step of engaging the blocking member with the conduit, thereby securing the conduit relative to the tubular member.

15. The method according to claim 14, wherein the blocking member engaging step further comprises biasing the flange against an interior surface of the tubular member.

16. The method according to claim 14, wherein the blocking member engaging step further comprises engaging a first profile formed on the blocking member with a second profile formed on the conduit.

17. The method according to claim 16, wherein the first profile engaging step further comprises biasing the flange against an interior surface of the tubular member.

18. The method according to claim 1, further comprising the step of forcing the tubular member toward a sidewall of the first wellbore, thereby decentralizing the tubular member within the first wellbore.

19. The method according to claim 18, wherein the tubular member forcing step further comprises increasing a clearance between the opening and the first wellbore.

20. The method according to claim 18, wherein the tubular member forcing step further comprises applying fluid pressure to the interior of the tubular member.

21. A method of forming a wellbore junction, the method comprising the steps of:

drilling a first wellbore;

underreaming a portion of the first wellbore;

providing a tubular member having an opening formed through a sidewall portion thereof, and a blocking member selectively positionable relative to the opening in a first position in which the blocking member blocks the opening and a second position in which the blocking member permits access through the opening;

positioning the tubular member within the first wellbore;

positioning the blocking member in the second position; and drilling a second wellbore by passing at least one cutting tool through the opening, the tubular member positioning step further comprising positioning the tubular member within the underreamed portion of the first wellbore.

22. A method of forming a wellbore junction, the method comprising the steps of:

drilling a first wellbore;

providing a tubular member having an opening formed through a sidewall portion thereof, and a blocking member selectively positionable relative to the opening in a first position in which the blocking member blocks the opening and a second position in which the blocking member permits access through the opening;

positioning the tubular member within the first wellbore;

positioning the blocking member in the second position;

drilling a second wellbore by passing at least one cutting tool through the opening;

attaching first and second packers axially straddling the tubular member;

sealingly engaging the first and second packers with the first wellbore; and forcing cementitious material into the first wellbore on sides of the first and second packers opposite the opening.

23. A method of forming a wellbore junction, the method comprising the steps of:

drilling a first wellbore;

providing a tubular member having an opening formed through a sidewall portion thereof, and a blocking member selectively positionable relative to the opening in a first position in which the blocking member blocks the opening and a second position in which the blocking member permits access through the opening;

positioning the tubular member within the first wellbore;

positioning the blocking member in the second position; and drilling a second wellbore by passing at least one cutting tool through the opening;

the tubular member providing step further comprising providing the tubular member with an outwardly extendable membrane surrounding the blocking member.

24. The method according to claim 23, further comprising the step of radially outwardly extending the membrane after the tubular member positioning step.

25. The method according to claim 24, wherein the extending step further comprises forcing fluid into the membrane.

26. The method according to claim 25, wherein the fluid forcing step further comprises forcing the fluid through the tubular member.

27. The method according to claim 24, wherein the extending step is performed after a step of depositing cementitious material into an annulus formed between the membrane and the first wellbore.

28. The method according to claim 23, wherein the second wellbore drilling step further comprises drilling through the membrane.

29. A method of forming a wellbore junction, the method comprising the steps of:

drilling a first wellbore;

providing a tubular member having an opening formed through a sidewall portion thereof, and a blocking member selectively positionable relative to the opening in a first position in which the blocking member blocks the opening and a second position in which the blocking member perm its access through the opening;

positioning the tubular member within the first wellbore, forcing the tubular member toward a sidewall of the first wellbore, thereby decentralizing the tubular member within the first wellbore;

outwardly extending a membrane surrounding the blocking member, thereby engaging the membrane with the first wellbore;

positioning the blocking member in the second position; and drilling a second wellbore by passing at least one cutting tool through the opening.

30. A method of forming a wellbore junction, the method comprising the steps of:

disposing a blocking member relative to a tubular member having an opening formed through a sidewall thereof, the blocking member being displaceable between a first position in which the blocking member prevents access through the opening, and a second position in which the blocking member permits access through the opening;

disposing a shielding device externally relative to the blocking member;

positioning the tubular member within a first wellbore;

positioning the blocking member in the second position; and passing at least one cutting tool through the opening, thereby drilling through the shielding device and drilling a second wellbore intersecting the first wellbore.

31. The method according to claim 30, further comprising the step of radially outwardly extending the shielding device into contact with the first wellbore.

32. The method according to claim 31, wherein the extending step is performed by applying fluid pressure to the shielding device.

33. The method according to claim 31, wherein the extending step is performed after forcing cementitious material into an annulus formed between the shielding device and the first wellbore.

34. The method according to claim 30, further comprising the step of displacing the opening laterally away from a sidewall of the first wellbore before the drilling step.

35. The method according to claim 34, wherein the displacing step is performed by applying fluid pressure to the tubular member.

36. The method according to claim 30, further comprising the step of engaging a flange with the tubular member about a periphery of the opening.

37. The method according to claim 36, wherein the flange engaging step further comprises sealingly engaging the flange with the tubular member.

38. The method according to claim 36, further comprising the steps of attaching a conduit to the flange, and installing the conduit within the second wellbore.

39. The method according to claim 38, wherein the conduit installing step further comprises passing the conduit through the opening.

40. The method according to claim 39, wherein the conduit installing step further comprises biasing the conduit outwardly relative to the opening, thereby biasing the flange against an interior surface of the tubular member.

41. The method according to claim 38, further comprising the step of engaging the blocking member with the conduit, thereby securing the conduit relative to the tubular member.

42. The method according to claim 41, wherein the blocking member engaging step further comprises biasing the flange against an interior surface of the tubular member.

43. The method according to claim 41, wherein the blocking member engaging step further comprises engaging a first profile formed on the blocking member with a second profile formed on the conduit.

44. The method according to claim 43, wherein the first profile engaging step further comprises biasing the flange against an interior surface of the tubular member.

45. Apparatus for forming a wellbore junction, the apparatus comprising:

a tubular member having an opening formed through a sidewall portion thereof;

a blocking member externally carried by the tubular member and being selectively positionable relative to the opening in a first position in which the blocking member blocks the opening, and a second position in which the blocking member permits access through the opening; and a deflection device assembly including a deflection device having an inclined surface formed thereon, the surface being aligned relative to the opening.

46. The apparatus according to claim 45, wherein the deflection device assembly is engaged with an orienting profile attached to the tubular member.

47. The apparatus according to claim 45, wherein the blocking member is sealingly engageable with the tubular member in the first position, preventing fluid flow through the opening.

48. The apparatus according to claim 45, wherein the blocking member is a sleeve externally disposed and axially reciprocable relative to the tubular member.

49. Apparatus for forming a wellbore junction, the apparatus comprising:

a tubular member having an opening formed through a sidewall thereof;

a blocking member displaceable relative to the tubular member and selectively permitting and preventing access through the opening; and a flange sealingly engaged with the tubular member about a periphery of the opening.

50. The apparatus according to claim 49, wherein the flange is sealingly engaged with an inner side surface of the tubular member.

51. The apparatus according to claim 49, wherein the flange is sealingly attached to a conduit extending outwardly from the tubular member.

52. The apparatus according to claim 51, wherein the conduit is in fluid communication with the interior of the tubular member via the flange.

53. The apparatus according to claim 49, wherein the flange is secured relative to the tubular member by engagement between the blocking member and a portion of the flange extending through the opening.

54. The apparatus according to claim 53, wherein a first profile formed on the blocking member is engaged with a second profile formed on the flange portion.

55. The apparatus according to claim 49, wherein the blocking member is a sleeve externally disposed and axially reciprocable relative to the tubular member.

56. Apparatus for forming a wellbore junction, the apparatus comprising:

a tubular member having an opening formed through a sidewall thereof;

a blocking member displaceable relative to the tubular member and selectively permitting and preventing access through the opening; and an enclosure outwardly disposed relative to the blocking member.

57. The apparatus according to claim 56, wherein the enclosure is an outwardly extendable membrane.

58. The apparatus according to claim 57, wherein the membrane has opposite ends, the opposite ends being attached to the tubular member axially straddling the blocking member.

59. The apparatus according to claim 56, wherein the enclosure is inflatable.

60. The apparatus according to claim 59, wherein the enclosure is inflatable in response to fluid pressure within the tubular member.

61. The apparatus according to claim 56, further comprising an decentralizing device attached to the tubular member.

62. The apparatus according to claim 61, wherein the decentralizing device is responsive to fluid pressure within the tubular member.

* * * * *